US005474582A

United States Patent [19]

Ignasiak et al.

[11] Patent Number: 5,474,582

[45] Date of Patent: Dec. 12, 1995

[54] COAL-WATER MIXTURES FROM LOW RANK COAL AND PROCESS OF PREPARATION THEREOF

[75] Inventors: Boleslaw Ignasiak; Wanda Pawlak; Kazimierz Szymocha; Yevgenia Briker, all of Edmonton, Canada; Loredana Caldiero, Settala Caleppio; Antonio Vettor, S. Donato Milanese, both of Italy

[73] Assignees: Alberta Research Council, Edmonton, Canada; Eniricerche, S.p.A., Milanese, Italy

[21] Appl. No.: 284,082

[22] Filed: Aug. 1, 1994

[30] Foreign Application Priority Data

Aug. 19, 1993 [IT] Italy ..... MI93A1836

[51] Int. Cl.[6] ..... C10L 5/00

[52] U.S. Cl. ..... 44/608; 44/620; 208/434

[58] Field of Search ..... 44/280, 571, 569, 44/592, 608, 620; 208/434

[56] References Cited

U.S. PATENT DOCUMENTS

| | | | |
|---|---|---|---|
| 3,762,887 | 10/1973 | Clancey et al. . | |
| 3,992,784 | 11/1976 | Verschuur et al. . | |
| 4,018,571 | 4/1977 | Cole et al. . | |
| 4,052,169 | 10/1977 | Cole et al. . | |
| 4,217,109 | 8/1980 | Siwersson et al. . | |
| 4,302,209 | 11/1981 | Baker et al. | 44/569 |
| 4,358,293 | 11/1982 | Mark . | |
| 4,360,422 | 11/1982 | Oka et al. | 44/571 |
| 4,515,602 | 5/1985 | Kelber, Jr. et al. | 44/280 |
| 4,521,218 | 6/1985 | Greenwald, Sr. | 44/280 |
| 4,662,894 | 5/1987 | Greenwald, Sr. | 44/280 |
| 4,830,634 | 5/1989 | Oder | 44/280 |
| 4,854,940 | 8/1989 | Janiak et al. . | |
| 5,035,721 | 7/1991 | Atherton | 44/608 |
| 5,338,322 | 8/1994 | Ignasiak et al. . | |

FOREIGN PATENT DOCUMENTS

| | | |
|---|---|---|
| 430626 | 11/1972 | Australia . |
| 1020477 | 11/1977 | Canada . |
| 1471949 | 4/1977 | United Kingdom . |
| 2099451 | 5/1982 | United Kingdom . |

OTHER PUBLICATIONS

Potas, T. A., et al Pilot–Scale Prepartion of Low Rank Coal/Water Fuels, The Journal of Coal Quality, Apr. 1987, p. 53.

*Primary Examiner*—Margaret Medley
*Attorney, Agent, or Firm*—Rodman & Rodman

[57] ABSTRACT

A process for preparing a coal-water fuel from a low rank coal. The first step of the process provides for an aqueous slurry containing particles of the low rank coal. A quantity of an agglomerating agent in the range of about 10% to 30% weight to dry ash - free low rank coal weight is added to the slurry to produce a mixture. The mixture is then agitated to form agglomerates. Following separation of the agglomerates, the agglomerates are contacted with steam or an inert gas having a temperature in the range of about 250° C. to 420° C. at substantially atmospheric pressure to produce partially deoiled agglomerates containing less than about 7% by weight of residual bridging liquid and having a moisture capacity reduced by a factor of at least about 2.5 at a relative humidity of 96% compared to the moisture capacity of the low rank coal. A first amount of the partially deoiled agglomerates is then first wet milled in the presence of water and at least one anionic dispersant, wherein the concentration of the first amount of the partially deoiled agglomerates in water is about 35% to 55% by weight, to produce a micronized fraction of the first amount of the partially deoiled agglomerates having a maximum size of about 15 to 25 micrometers and an average diameter of about 4 to 10 micrometers. Finally, a combination of the micronized fraction of the first amount of the partially deoiled agglomerates and a second amount of the partially deoiled agglomerates is final wet milled in the presence of water, wherein the combination is comprised of about 20% to 50% by weight of the micronized fraction, to produce the coal-water fuel which contains solid particles having a maximum size of about 250 to 300 micrometers and an average diameter of about 15 to 30 micrometers. In a further embodiment, the process utilizes a paste in place of the agglomerates, the paste being formed by mixing particles of the low rank coal with a quantity of a bridging liquid.

27 Claims, No Drawings

COAL-WATER MIXTURES FROM LOW RANK COAL AND PROCESS OF PREPARATION THEREOF

TECHNICAL FIELD

The present invention relates to coal-water mixtures from low rank coal (LRC) and a process of preparation thereof. Specifically, the present invention relates to a process for preparing a coal-water fuel from a low rank coal.

BACKGROUND ART

Coal as an energy source is in abundant supply.

The substitution of coal for natural gas and oil on a large scale would therefore appear to be an easy solution to our energy shortage.

Unfortunately, however, unlike oil and gas consumption, coal use is limited not by reserve or production capacity but rather by extraordinary industrial and regulatory difficulties in burning it in a convenient, efficient and environmentally acceptable manner.

A number of techniques are being explored to provide coal as a more useful energy source, for example gasification and high pressure hydrogenation.

Another technique is the technique whereby solid coal particles are dispersed in water to form coal-water mixtures. Such coal-water mixtures offer considerable advantages. They are more readily transported than the dry solid coal, are more easily stored and are less subjected to the risks of explosion by spontaneous ignition, the latter being a significant factor in coal handling.

In addition, providing coal in a fluid form can permit its burning in apparatus normally used for burning fuel oil. This can greatly facilitate the transition from fuel oil to coal as a primary energy source, another highly desirable result.

Various coal-water mixtures are described in the literature.

In U.S. Pat. No. 3,762,887, there is disclosed a dispersion of coal in an aqueous medium wherein the coal is ground to a defined range of particle sizes, a substantial portion of which being about 325 mesh Tyler Standard screen (44 micrometers) or even finer.

U.S. Pat. No. 4,217,109 discloses a technique for cleaning and dispersing coal in water utilizing dispersing agents which by selective adsorption impart different electrical charges to the carbon particles and the impurities. The dispersing agents taught are polyelectrolytes such as metal and ammonium salts of polycarboxylic acids and polyphosphates.

U.S. Pat. No. 4,358,293 discloses high coal concentration coal-water mixtures dispersed by non-ionic polyalkyleneoxide surfactants.

GB-A-2,099,451 teaches how to generate dense coal-water suspensions for pipeline transportation and direct firing of bituminous coal slurries in electric power plants.

Many other patents concern different, more effective, and cheaper dispersing agents.

The coal-water slurry fuels (CWF) are generated, as a rule, using high volatile bituminous coals. Generation of CWF from low rank coal, such as sub-bituminous and lignites, is not technically or economically feasible with existing technologies.

Low rank coals are defined as coals having a carbon content ranging from about 60% to 78% by weight (daf), and a relatively high oxygen content, ranging from about 16% to 25% by weight (daf). Other characteristics of low rank coals are a relatively high moisture content in the range of about 10% to 40%, a high dry ash content in the range of about 12% to 40%, volatile materials greater than about 38% (daf), fixed carbon of less than about 62% (daf), and about 1% to 10% of oxygen in form of process.

Most countries with LRC reserves have conducted research to develop a non-evaporative, high-pressure, continuous process to produce a dry product based on the principles of the Fleissner process.

Australian Patent 430,626 (1970) discloses a continuous hot-water coal drying process for brown coal in Australia.

Similar processes are described in U.S. Pat. Nos. 4,018,571, 4,052,169, 3,992,784, GB-A-1,471,949 and Canada 1,020,477. Commercialization of this technology, however, has lagged due to the difficulties in separating the dewatered product from the free water used to transport the coal through the process.

Since 1983, the University of North Dakota Energy Research Centre has been studying the hot-water coal drying process to produce CWF from LRC.

T. A. Potas, G. G. Baker and D. J. Maas, describe in the Journal of Coal Quality, April 1987, a pilot scale preparation of low rank coal-water fuels by hydrothermal treatment at a temperature between 270° C. and 330° C. This process suffers the drawback of a high pressure apparatus requirement. Moreover, product coals are inadequately upgraded, the equilibrium moisture and the oxygen content being too high for a good CWF. Finally, some CWFs are not very fluid and settled to form a hard pack in some hours.

Therefore, there remains in the art a need for a process which, operating under mild conditions, effectively upgrades low rank coal to yield fluid and stable coal-water fuels.

DISCLOSURE OF INVENTION

The present invention relates to a process for preparing pumpable coal-water mixtures from low rank coal, comprising, in a first step, upgrading the low rank coal, and, in a second step, preparing fluid, high calorific value coal-water mixtures.

In a first aspect of the invention, the invention comprises a process for preparing a coal-water fuel from a low rank coal comprising the steps of:

(a) providing an aqueous slurry containing particles of the low rank coal;

(b) adding a quantity of an agglomerating agent to the slurry to produce a mixture, the quantity of the agglomerating agent being in the range of about 10% to 30% weight to dry ash - free low rank coal weight;

(c) agitating the mixture to form agglomerates of the low rank coal particles;

(d) separating the agglomerates and contacting the separated agglomerates with steam or an inert gas having a temperature in the range of about 250° C. to 420° C. at substantially atmospheric pressure to produce partially deoiled agglomerates containing less than about 7% by weight of residual bridging liquid and having a moisture capacity reduced by a factor of at least about 2.5 at a relative humidity of 96% compared to the moisture capacity of the low rank coal;

(e) first wet milling a first amount of the partially deoiled agglomerates in the presence of water and at least one anionic dispersant, wherein the concentration of the first amount of the partially deoiled agglomerates in water is about 35% to 55% by weight, in order to produce a micronized fraction of the first amount of the partially deoiled agglomerates having a maximum size of about 15 to 25 micrometers and an average diameter of about 4 to 10 micrometers; and (f) final wet milling a combination of the micronized fraction of the first amount of the partially deoiled agglomerates and a second amount of the partially deoiled agglomerates in the presence of water, wherein the combination is comprised of about 20% to 50% by weight of the micronized fraction, in order to produce the coal-water fuel containing solid particles having a maximum size of about 250 to 300 micrometers and an average diameter of about 15 to 30 micrometers.

In the first aspect, the agglomerating agent is preferably selected from the group consisting of a bridging liquid and a bridging liquid mixed with a diluent. The bridging liquid is preferably selected from the group consisting of a bitumen, a heavy oil and an emulsion of a bitumen or a heavy oil. Where a bitumen is selected, the bitumen preferably has a specific gravity in the range of about 5.5° to 12° API. Where a heavy oil is selected, the heavy oil preferably has a specific gravity in the range of about 10° to 20° API.

Further, where the agglomerating agent is a bridging liquid mixed with a diluent, the diluent is preferably a light hydrocarbon. As well, the diluent may be mixed with the bridging liquid at a ratio of the bridging liquid to the diluent in the range of about 0.50 to 0.98. Preferably, the ratio of the bridging liquid to the diluent is in the range of about 0.75 to 0.95.

The concentration of the low rank coal particles in the slurry may be about 20% to 50%, however, it is preferably about 25% to 45%. As well, the diameter of the low rank coal particles may be less than about 2 millimeters, or in the range of about 0.01 to 0.6 millimeters. Preferably, the diameter of the low rank coal particles is in the range of about 0.01 to 0.2 millimeters.

The quantity of the agglomerating agent added to the slurry may be in the range of about 12% to 24% weight to dry ash - free low rank coal weight, preferably, in the range of about 12% to 18%.

The separated agglomerates may be contacted with steam or inert gas having a temperature in the range of about 270° C. to 330° C. or may be contacted with steam or inert gas having a temperature in the range of about 300° C. to 400° C.

In the preferred embodiment, the concentration of the first amount of the partially deoiled agglomerates in water is about 40% to 50% by weight and the average diameter of the micronized fraction is about 6 to 8 micrometers. Further, in the preferred embodiment, the combination of the micronized fraction of the first amount of the partially deoiled agglomerates and the second amount of the partially deoiled agglomerates is comprised of about 30% to 40% by weight of the micronized fraction and the average diameter of the solid particles contained in the produced coal-water fuel is about 18 to 25 micrometers.

In a second aspect of the invention, the invention is comprised of a process for preparing a coal-water fuel from a low rank coal, comprising the steps of:

(a) mixing particles of the low rank coal with a quantity of a bridging liquid to produce a paste, the quantity of the bridging liquid being in the range of about 10% to 30% weight to dry ash - free low rank coal weight;

(b) contacting the paste with steam or an inert gas having a temperature in the range of about 250° C. to 420° C. at substantially atmospheric pressure to produce a partially deoiled paste containing less than about 7% by weight of residual bridging liquid and having a moisture capacity reduced by a factor of at least about 2.5 at a relative humidity of 96% compared to the moisture capacity of the low rank coal;

(c) first wet milling a first amount of the partially deoiled paste in the presence of water and at least one anionic dispersant, wherein the concentration of the first amount of the partially deoiled paste in water is about 35% to 55% by weight, in order to produce a micronized fraction of the first amount of the partially deoiled paste having a maximum size of about 15 to 25 micrometers and an average diameter of about 4 to 10 micrometers; and (d) final wet milling a combination of the micronized fraction of the first amount of the partially deoiled agglomerates and a second amount of the partially deoiled agglomerates in the presence of water, wherein the combination is comprised of about 20% to 50% by weight of the micronized fraction, in order to produce the coal-water fuel containing solid particles having a maximum size of about 250 to 300 micrometers and an average diameter of about 15 to 30 micrometers.

In the second aspect of the invention, the process may be further comprised of the step of pelletizing the paste prior to contacting it with steam or an inert gas.

Further, in the preferred embodiment of the second aspect of the invention, the bridging liquid is selected from the group consisting of a bitumen, a heavy oil and an emulsion of a bitumen or a heavy oil. Where a bitumen is selected, the bitumen preferably has a specific gravity in the range of about 5.5° to 12° API. Where a heavy oil is selected, the heavy oil preferably has a specific gravity in the range of about 10° to 20° API.

In the second aspect, the diameter of the low rank coal particles may be less than about 2 millimeters, preferably in the range of about 0.01 to 0.6 millimeters. The quantity of the bridging liquid mixed with the low rank coal is preferably in the range of about 20% to 30% weight to dry ash - free coal weight. The partially deoiled paste may be contacted with steam or inert gas having a temperature in the range of about 270° C. to 330° C. or having a temperature in the range of about 300° C. to 400° C.

The concentration of the first amount of the partially deoiled paste in water is preferably about 40% to 50% by weight and the average diameter of the micronized fraction is preferably about 6 to 8 micrometers. Further, the combination of the micronized fraction of the first amount of the partially deoiled paste and the second amount of the partially deoiled paste is preferably comprised of about 30% to 40% by weight of the micronized fraction and the average diameter of the solid particles contained in the coal-water fuel is preferably about 18 to 25 micrometers.

BEST MODE OF CARRYING OUT INVENTION

The invention is comprised of a process for preparing a coal-water fuel from a low rank coal. Low rank coal is defined as coal having a carbon content ranging from about 60% to 78% by weight (daf), and a relatively high oxygen content, ranging from about 16% to 25% by weight (daf). Other characteristics of the low rank coal include a relatively high moisture content in the range of about 10% to 40%, a high dry ash content in the range of about 12% to 40%, a volatile materials content greater than about 38% (daf), a fixed carbon content of less than about 62% (daf), and in the range of about 1% to 10% of oxygen in the form of process.

The first step in the process is providing an aqueous slurry containing particles of the low rank coal. Next, a quantity of an agglomerating agent is added to the slurry to produce a mixture. The agglomerating agent may be either a bridging liquid used alone or a bridging liquid and a diluent. In the preferred embodiment, the agglomerating agent is a bridging liquid mixed with a diluent for the bridging liquid.

In general, heavy oil having a specific gravity in the range of about 10° to 20° API, bitumen having a specific gravity in the range of about 5.5° to 10° API, or any other low quality oil may be utilized as a bridging liquid. By low quality oils, it is generally meant to include those oils having the following characteristics: API gravity of 7 to about 20; specific gravity (at 20° C.) of about 0.900 to 1.100; sulphur content of 2% to 5%; viscosity (cst at 40° C.) in the range of 3 to 500; and further characterized as being marginally distillable and generally having high heteroatom and contaminant contents. The bridging liquid may also be an emulsified product, however, in this case, the use of a light hydrocarbon diluent is usually not required.

The diluent, which is added to the bridging liquid in order to lower the viscosity of the bridging liquid, is preferably a light hydrocarbon. The light hydrocarbon is preferably kerosene, diesel oil or naptha.

The ratio of bridging liquid to diluent is in the range of about 0.50 to 0.98, preferably in the range of about 0.75 to 0.95. When the bridging liquid is selected from bitumen emulsion or heavy oil emulsion, addition of a light hydrocarbon diluent is usually not required.

The quantity of the bridging liquid plus the diluent comprising the agglomerating agent added to the slurry is in the range of about 10% to 30% weight to dry ash - free coal weight, preferably in the range of 12% to 24%.

The agglomeration process is preferably conducted in a step-wise manner, so as to effect gradually selective agglomeration of the coal-rich particles. The agglomeration process may be undertaking continously utilizing, for example, a pipeline or a stirred tank. In the preferred embodiment, the mixture of the agglomerating agent and the slurry is agitated to form agglomerates of the low rank coal particles.

The time required to reach agglomeration equilibrium varies in accordance with several factors, namely reactor type, the agglomerating agent, concentration, agitation and coal type.

Agglomerate growth proceeds until a particular agglomerate size is attained. Agglomerate size is dependent upon the coal composition, agglomerating agent composition and agitation intensity. The diameter of the formed agglomerates would however preferably be in the range of 0.6 to 10 millimeters.

The aforesaid agglomerates are then separated by conventional methods, such as centrifugation or filtration. The separated agglomerates are then introduced into a heating zone in any convenient manner known in the art at atmospheric pressure or under a slight vacuum. In the preferred embodiment, the separated agglomerates are introduced into the heating zone at substantially atmospheric pressure.

In the heating zone, the separated agglomerates will be heated, preferably in an inert atmosphere, for example with steam or nitrogen. The heating will result in the generation or production of a distillable oil and hardened, partially deoiled agglomerates. The temperature in the heating zone will be in the range of about 250° C. to 420° C., preferably in the range of about 300° C. to 400° C. Utilizing a temperature higher than 420° C. usually results in lowering the volatile matter contents of the partially deoiled agglomerates below acceptable levels.

By recovering the distillable oil from the agglomerates formed from the low rank coal particles and the agglomerating agent in this manner, the moisture capacity of the resultant partially deoiled agglomerates is reduced by a factor of about 2.5 to 3, at a relative humidity of 96%, as compared to the raw low rank coal particles.

The resultant partially deoiled agglomerates made in accordance with the within process typically contain less than 7% by weight (dry coal basis) of residual bridging liquid. As well, typically 45% to 98% of the initially used bridging liquid is recovered (as a distillable oil).

For some specific low rank coals, characterized by moderate to low ash levels, the oil agglomeration steps described above may be replaced by the preparation of a coal-bridging liquid paste. The coal is ground to a particle size diameter below about 2 millimeters, preferably in the range of about 0.01 millimeters to 0.6 millimeters. The particles of the low rank coal are then mixed with a specified amount of bridging liquid, being in the range of about 10% to 30% weight of dry ash-free low rank coal weight, preferably in the range of about 20% to 30%. Conventional heavy duty mixers for paste preparation may be utilized. The mixing is continued until a homogenous paste-like mixture is formed. The low rank coal - bridging liquid paste may then be subjected for agglomeration in any conventional manner known in the art, i.e. pelletization, extrusion or bricketting.

Finally, the upgraded coal agglomerates, in the form of partially deoiled agglomerates, are wet milled in order to prepare fluid CWFs having the desired particle size distribution. Coal agglomerates are submitted to two successive wet millings.

The first wet milling is a micronization of the deoiled agglomerates carried out in the presence of additives, with a solid/liquid weight ratio comprised within the range of 35/65 to 55/45, preferably in the range of about 40/60 to 50/50, until an aqueous suspension is obtained with solid particles having a maximum size in the range of about 15 to 25 micrometers and an average diameter in the range of about 4 to 10 micrometers, preferably in the range of about 6 to 8 micrometers. In the preferred embodiment, a portion or a first amount of the partially deoiled agglomerates undergoes first wet milling in the presence of water and at least one anionic dispersant. The first wet milling produces a micronized fraction of the first amount of the partially deoiled agglomerates. The micronized fraction contains solid particles having the characteristics set out above.

The second wet milling is applied to a charge formed by: (a) the aqueous suspension coming from the first milling; and (b) granulated deoiled agglomerates. In the preferred embodiment, the final wet milling step is performed on a combination of the micronized fraction of the first amount of the partially deoiled agglomerates and a further second amount of the partially deoiled agglomerates in the presence of water such that a slurry is formed. The combination of the micronized fraction and the second amount of the partially deoiled agglomerates is made up of about 20% to 50% by weight of the micronized fraction, preferably in the range of about 30% to 40% by weight. The second wet milling is performed to produce the coal-water fuel and is continued until a maximum size of the solid particles contained in the coal-water fuel of 300 micrometers is obtained (with the retained fraction over 250 micrometers less than 1 to 2 wt percent). Further, in the preferred embodiment, the second wet milling is continued until solid particles having a maximum size of 250 to 300 micrometers and an average diameter of 18 to 25 micrometers are obtained.

The additives to be used in the first milling are selected among the anionic polyelectrolytes, preferably alkaline and alkaline heart salts of condensates of naphthalene sulphonic acid with formaldehyde. The additive is used at a percentage comprising between 0.3% and 3% by weight relative to the solid.

The fine fraction is micronized in the first wet milling to the herein above reported dimensions and in the specific ratio relative to the water, forming a suspension which is fed to the second mill as diluent medium, the balance of the charge to the second mill being the coarse fraction.

The so prepared CWFs are typically fluid and pumpable without any particular problem.

The storage stability may be improved by wellknown additives such as sodium bentonite, guar gum, etc.

Further, the above described process may result in fluid, pumpable and stable slurries of a high quality fuel.

Furthermore, another advantage of the process of the within invention may be the upgrading of the heavy oil used in the oil agglomeration or paste preparation step. In contrast to the feed heavy oil used as the bridging liquid, the recovered distillable oil is typically characterized by lower density and viscosity, reduced heteroatom content, and the absence of asphaltenic fraction.

Finally, special equipment, such as pressurized apparatus, is not typically required by the process of the present invention.

The following non-limiting examples describe in greater detail the process of the present invention:

EXAMPLES

Oil Agglomeration

Batch wise oil agglomeration tests are conducted in a single or two-stage manner depending on the ash content of the coal and its agglomerating ability.

Single-stage agglomeration tests are conducted in 2.2 $dm^3$ cylindrical vessel with a diameter of 140 millimeters and equipped with 4 baffles in order to increase the turbulence in the vessel. Agitation is provided by a 4-bladed turbine impeller, with an impeller to vessel diameter of 0.44. The impeller is located 20 millimeters above the bottom of the vessel and is operated at an angular velocity of 84 rd/sc. A variable speed stirrer provides the necessary rpm and the impeller torque is monitored electronically.

Depending on the response to agglomeration and ash content of the coal, the oil agglomeration can be either a 1-stage process or a 2-stage process. In a 1-stage process, low rank coal ground to a particle size diameter below about 2 millimeters, preferably in the range of about 0.01 to 0.2 millimeters, is mixed with water in order to obtain the aqueous coal slurry with a solid concentration of 20% to 50%, more preferably in the range of about 25% to 45%. The slurry is agitated for 1 minute to ensure complete wetting and then a specified amount of an agglomerating agent, in a range of about 10% to 30% weight of dry ash - free coal weight, preferably in the range of 12% to 24%, is added to produce a mixture. The mixture is agitated at 2400 rpm (high shear mixing) to the moment when the phase separation occurred. After that, the mixture rate is reduced to 1600 rpm (low shear mixing) and agitation is continued until a particular agglomerate is attained, usually being in the range of about 0.6 to 10 millimeters. The agglomerates are separated by screening, using laboratory sieves, and then subjected to thermal treatment.

In the 2-stage process, the first stage resembles the single-stage process with the difference in agglomerating agent addition and residence time. The agglomerating agent is added in the amount of 0.5% to 5% weight of dry ash - free coal weight and agitation extended for 1 to 4 minutes.

Microagglomerates are separated by filtration or by flotation, resuspended in water and the remaining quantity of agglomerating agent is added. After that, the agitation is continued until a particular agglomerate size is attained, usually being in the range of about 0.6 to 10 millimeters.

Coal/Bridging Liquid Paste Preparation

Batchwise paste preparation tests are conducted in a bench-type heavy duty mixer with a holding capacity of 2 kilograms. The coal is ground to a particle size diameter being below about 2 millimeters, preferably in the range of about 0.01 to 0.6 millimeters and is mixed with a specified amount of the bridging liquid being in the range of about 10% to 30% weight of dry ash - free coal weight, preferably in the range of about 20% to 30%. The mixing is continued until a homogeneous paste-like mixture is formed.

The paste may be fed directly to the thermal treatment unit or processed into pellets before thermal treatment by using a laboratory type disk/drum pelletizer or extruder.

Thermal Treatment

The batchwise oil recovery experiments are conducted in the unit comprised of a steam generator, inert gas supply and heating and condensation sections. The steam is generated by passing water through a heating coil immersed in a fluidized sand bath with a maximum operating temperature of about 450° C. Water is pumped through this coil by a metering pump from a container placed on a top-load scale. The inert gas supply is provided from industrial gas cylinders.

The heating section consists of a rotating glass reactor with baffles, heated by infrared radiation, under slight positive pressure of inert gases. The clam-shell type infrared oven has a water cooled jacket and can reach the desired temperatures of 200° C. to 900° C. in 0.5 to 3 minutes. The oven is equipped with power-level and temperature controls for variable heating rates and low-water-flow cut-off for overheating protection. The temperature is monitored using a thermal couple placed directly in the sample bed. The glass reactor is rotated at various speeds by a modified rotavapor apparatus. The reactor is connected to a multi-bulb cooler/condensor (also rotating). The evolved gases are condensed in the glass cooler section, and the remaining gases are passed through a second condensor, an active carbon trap and a cold trap before being released.

In a thermal treatment test, a sample of agglomerates, or paste, or pellets obtained from the paste, in the amount of about 200 grams is placed in a glass reactor. The reactor is connected to the condensor and the whole assembly is attached to the rotavapor apparatus. While rotating, the reactor is first purged with cool inert gas, and then the oven is turned on. The heating rate is adjusted and maintained in comparative tests. The flow rate of carrier gas (steam or nitrogen) is adjusted. The process is carried out at the desired temperature, being the range of 250° C. to 420° C., preferably in the range of 300° C. to 400° C., for a predetermined time and the contents of the reactor are quenched by cold carbon dioxide. After completion of the tests, both the reactor and the condensor contents are weighed. The condensor is then placed into the distillation setup and water content in the condensate is determined by azeotropic distillation with toluene. The recovery of oil is calculated by mass balance and checked against the actual recovered amount.

Slurryfication

Slurryfication is performed by two different steps:

(a) Micronization

The deoiled agglomerates are wet-ground in a mill of internal dimensions 240×203 millimeters, using the following grinding load (in AISI 420 steel):

3.2 kilograms of balls of diameter 31.75 millimeters;
4.8 kilograms of balls of diameter 25.40 millimeters;
3.2 kilograms of balls of diameter 12.70 millimeters; and
4.8 kilograms of balls of diameter 9.53 millimeters.

1.8 kilograms of deoiled agglomerates are milled with the jar rotating at 70 rpm. The concentration of deoiled agglomerates in water is 40% to 45%, and micronization is performed in the presence of a dispersant (at a concentration of 1% weight with respect to the total weight of the solid) consisting of a sodium salt of naphthalene sulphonic acid condensed with formaldehyde.

Milling is carried out for 2 hours by which the average diameter of the coal particles is reduced to about 8 micrometers.

(b) Second Milling

The second milling, by a rod mill, is applied to a charge formed by an aqueous suspension of particles of deoiled solid coming from the first milling and by granulated solid (maximum size of 6 millimeters), the weight ratio between the two components (coarse/micronized) being 65/35.

Dispersant is added also in this step, in order to reach the final value.

The second milling is continued until the maximum size of granulated coal is 300 micrometers, with an average diameter of 18 to 25 micrometers. Sodium bentonite was added during the first milling in order to improve the settling stability of CWFs.

Determination of CWFs average diameter was performed analyzing the particle size distribution under 190 micrometers by a laser scattering analyzer. CWFs rheological properties, such as apparent viscosity at 10 $s^{-1}$, peculiar gradient for long distance pumping, were investigated using a rotational viscometer Contraves, Rheomat 115.

(c) Coal and CWFs Characteristics

Table 1 reports the main features of the raw low rank coal and of the deoiled agglomerates (in presence of $N_2$, called AGFT-$N_2$, and $H_2O$, called AGFT-H $_2$O).

TABLE 1

| | Raw | AGFT-$N_2$ | AGFT-$H_2O$ |
|---|---|---|---|
| Moist. Cap. (wt %): | 25.13 | 8.64 | 9.04 |
| Proximate anal. (wt %, dry basis) | | | |
| Ash: | 7.2 | 8.3 | 7.6 |
| Volatile matter: | 40.2 | 34.2 | 34.7 |
| Fixed carbon: | 52.6 | 57.5 | 57.7 |

TABLE 1-continued

| | Raw | AGFT-$N_2$ | AGFT-$H_2O$ |
|---|---|---|---|
| Ultimate analysis (wt %, dry basis) | | | |
| Carbon: | 67.2 | 73.5 | 72.9 |
| Hydrogen: | 4.4 | 4.2 | 4.1 |
| Nitrogen: | 1.7 | 1.7 | 1.8 |
| Sulphur: | 0.6 | 1.4 | 1.3 |
| Oxygen (by diff.) | 18.9 | 10.9 | 12.4 |
| Gross Cal. Value (moist. cap. basis) | | | |
| Btu/lb: | 8,240 | 11,090 | 12,870 |
| cal/g: | 4,580 | 6,160 | 6,040 |

The main difference concerning raw low rank coal and the deoiled agglomerates is the capacity moisture content, which in the raw low rank coal is almost 2.5 times higher than in the deoiled samples. This parameter greatly affects the rheological properties of the final CWFs.

In Table 2 are reported the main features of some CWFs prepared according to the invention. As comparison, Table 2 also reports the characteristics of the CWF prepared from raw low rank coal.

TABLE 2

| | Raw | | AGFT-$N_2$ | | AGFT-$H_2O$ | |
|---|---|---|---|---|---|---|
| solid conc. (wt %) | 44.6 | 46.1 | 58.0 | 60.0 | 58.6 | 59.1 |
| Dispersant (wt %) | 0.7 | 1.0 | 0.5 | 0.7 | 0.7 | 1.0 |
| Stabilizer (wt %) | 0.2 | 0.2 | 1.0 | 1.0 | 1.0 | 1.0 |
| Average diameter (μm) | 23.3 | 19.9 | 19.0 | 21.8 | 20.6 | 20.6 |
| +190 μm | 10.6 | 5.9 | 4.6 | 5.6 | 3.2 | 3.4 |
| +300 μm | <0.1 | <0.1 | 0.3 | 0.6 | 0.2 | 0.6 |
| App. viscosity ($10s^{-1}$) (Pa s) | 1.8 | 3.0 | 1.5 | 1.9 | 1.7 | 1.5 |
| App. viscosity ($100s^{-1}$) (Pa s) | 0.73 | 1.2 | 0.87 | 1.1 | 1.0 | 0.9 |

Table 3 reports some properties of CWFs prepared from AGFT-$N_2$ without any addition of stabilizer.

TABLE 3

| AGFT-$N_2$ (wt %) | App. viscosity ($10s^{-1}$) Pas | App. viscosity ($100s^{-1}$) Pas |
|---|---|---|
| 60.2 | 0.7 | 0.8 |
| 61.7 | 1.3 | 1.0 |

The embodiments of the invention in which an exclusive property or privilege is claimed are defined as follows:

1. A process for preparing a coal-water fuel from a low rank coal, comprising the steps of:

(a) providing an aqueous slurry containing particles of the low rank coal;

(b) adding a quantity of an agglomerating agent selected from the group consisting of a bridging liquid and a bridging liquid mixed with a diluent to the slurry to produce a mixture, the quantity of the agglomerating agent being in the range of about 10% to 30% weight of dry ash - free low rank coal weight;

(c) agitating the mixture to form agglomerates of the low rank coal particles;

(d) separating the agglomerates and contacting the separated agglomerates with steam or an inert gas having a temperature in the range of about 250° C. to 420° C. at substantially atmospheric pressure to produce partially deoiled agglomerates containing less than about 7% by weight of residual bridging liquid and having a moisture capacity reduced by a factor of at least about 2.5 at a relative humidity of 96% compared to the moisture capacity of the low rank coal;

(e) first wet milling a first amount of the partially deoiled agglomerates in the presence of water and at least one anionic dispersant, wherein the concentration of the first amount of the partially deoiled agglomerates in water is about 35% to 55% by weight, in order to produce a micronized fraction of the first amount of the partially deoiled agglomerates having a maximum size of about 15 to 25 micrometers and an average diameter of about 4 to 10 micrometers;

(f) final wet milling a combination of the micronized fraction of the first amount of the partially deoiled agglomerates and a second amount of the partially deoiled agglomerates in the presence of water, wherein the combination is comprised of about 20% to 50% by weight of the micronized fraction, in order to produce the coal-water fuel containing solid particles having a maximum size of about 250 to 300 micrometers and an average diameter of about 15 to 30 micrometers.

2. The process as claimed in claim 1 wherein the bridging liquid is selected from the group consisting of a bitumen, a heavy oil and an emulsion of a bitumen or a heavy oil.

3. The process as claimed in claim 2 wherein the bitumen has a specific gravity in the range of about 5.5° to 12° API.

4. The process as claimed in claim 2 wherein the heavy oil has a specific gravity in the range of about 10° to 20° API.

5. The process as claimed in claim 2 wherein the diluent is a light hydrocarbon and the diluent is mixed with the bridging liquid at a ratio of the bridging liquid to the diluent in the range of about 0.50 to 0.98.

6. The process as claimed in claim 5 wherein the concentration of the low rank coal particles in the slurry is about 20% to 50% and the diameter of the low rank coal particles is less than about 2 millimeters.

7. The process as claimed in claim 6 wherein the concentration of the low rank particles in the slurry is about 25% to 45% and the diameter of the low rank coal particles is in the range of about 0.01 to 0.6 millimeters.

8. The process as claimed in claim 7 wherein the diameter of the low rank coal particles is in the range of about 0.01 to 0.2 millimeters.

9. The process as claimed in claim 5 wherein the quantity of the agglomerating agent added to the slurry is in the range of about 12% to 24% weight to dry ash - free low rank coal weight.

10. The process as claimed in claim 9 wherein the quantity of the agglomerating agent added to the slurry is in the range of about 12% to 18% weight to dry ash - free low rank coal weight.

11. The process as claimed in claim 5 wherein the ratio of the bridging liquid to the diluent is in the range of about 0.75 to 0.95.

12. The process as claimed in claim 6 wherein the steam or inert gas has a temperature in the range of about 270° C. to 330° C.

13. The process as claimed in claim 5 wherein the steam or inert gas has a temperature in the range of about 300° C. to 400° C.

14. The process as claimed in claim 6 wherein the concentration of the first amount of the partially deoiled agglomerates in water is about 40% to 50% by weight and the average diameter of the micronized fraction is about 6 to 8 micrometers.

15. The process as claimed in claim 6 wherein the combination is comprised of about 30% to 40% by weight of the micronized fraction and the average diameter of the solid particles is about 18 to 25 micrometers.

16. A process for preparing a coal-water fuel from a low rank coal, comprising the steps of:

(a) mixing particles of the low rank coal with a quantity of a bridging liquid to produce a paste, the quantity of the bridging liquid being in the range of about 10% to 30% weight to dry ash - free low rank coal weight;

(b) contacting the paste with steam or an inert gas having a temperature in the range of about 250° C. to 420° C. at substantially atmospheric pressure to produce partially deoiled paste containing less than about 7% by weight of residual bridging liquid and having a moisture capacity reduced by a factor of at least about 2.5 at a relative humidity of 96% compared to the moisture capacity of the low rank coal;

(c) first wet milling a first amount of the partially deoiled paste in the presence of water and at least one anionic dispersant, wherein the concentration of the first amount of the partially deoiled paste in water is about 35% to 55% by weight, in order to produce a micronized fraction of the first amount of the paste having a maximum size of about 15 to 25 micrometers and an average diameter of about 4 to 10 micrometers;

(d) final wet milling a combination of the micronized fraction of the first amount of the partially deoiled paste and a second amount of the partially deoiled paste in the presence of water, wherein the combination is comprised of about 20% to 50% by weight of the micronized fraction, in order to produce the coal-water fuel containing solid particles having a maximum size of about 250 to 300 micrometers and an average diameter of about 15 to 30 micrometers.

17. The process as claimed in claim 16 further comprising the step of pelletizing the paste prior to contacting the paste with steam or an inert gas.

18. The process as claimed in claim 16 wherein the bridging liquid is selected from the group consisting of a bitumen, a heavy oil and an emulsion of a bitumen or a heavy oil.

19. The process as claimed in claim 18 wherein the bitumen has a specific gravity in the range of about 5.5° to 12° API.

20. The process as claimed in claim 18 wherein the heavy oil has a specific gravity in the range of about 10° to 20° API.

21. The process as claimed in claim 16 wherein the diameter of the low rank coal particles is less than about 2 millimeters.

22. The process as claimed in claim 21 wherein the diameter of the low rank coal particles is in the range of about 0.01 to 0.6 millimeters.

23. The process as claimed in claim 16 wherein the quantity of the bridging liquid is in the range of about 20% to 30% weight to dry ash - free coal weight.

24. The process as claimed in claim 16 wherein the steam or inert gas has a temperature in the range of about 270° C. to 330° C.

25. The process as claimed in claim 16 wherein the steam or inert gas has a temperature in the range of about 300° C. to 400° C.

26. The process as claimed in claim 16 wherein the concentration of the first amount of the partially deoiled paste in water is about 40% to 50% by weight and the average diameter of the micronized fraction is about 6 to 8 micrometers.

27. The process as claimed in claim 16 wherein the combination is comprised of about 30% to 40% by weight of the micronized fraction and the average diameter of the solid particles is about 18 to 25 micrometers.

* * * * *

UNITED STATES PATENT AND TRADEMARK OFFICE

CERTIFICATE OF CORRECTION

PATENT NO. : 5,474,582

DATED : December 12, 1995

INVENTOR(S) : Boleslaw Ignasiak, et al.

It is certified that error appears in the above-identified patent and that said Letters Patent is hereby corrected as shown below:

In Column 11, line 60, change "6" to --5--;

line 66, change "6" to --5--;

In Column 12, line 4, change "6" to --5--.

Signed and Sealed this

Second Day of April, 1996

Bruce Lehman

*Attest:*

BRUCE LEHMAN

*Attesting Officer*

*Commissioner of Patents and Trademarks*